US005350514A

United States Patent [19]

Witthaus et al.

[11] Patent Number: 5,350,514

[45] Date of Patent: Sep. 27, 1994

[54] CENTRIFUGE

[75] Inventors: Friedrich Witthaus, Wendel-Osterbruecken; Wolfram Weber, Spiesen-Elversberg; Wolfgang Biesel, Ottweiler; Carlo Lay, Saarwellingen, all of Fed. Rep. of Germany

[73] Assignee: Fresenius AG, Bad Homburg, Fed. Rep. of Germany

[21] Appl. No.: 79,162

[22] Filed: Jun. 18, 1993

[30] Foreign Application Priority Data

Jun. 20, 1992 [DE] Fed. Rep. of Germany ..... 4220232

[51] Int. Cl.[5] ..... B04B 5/00

[52] U.S. Cl. ..... 210/360.1; 210/512.1; 494/18; 494/84

[58] Field of Search ..... 210/360.1, 380.1, 512.1; 494/18, 84

[56] References Cited

U.S. PATENT DOCUMENTS 4,163,519 9/1993 Stabile .
4,194,684 3/1980 Boggs ..... 494/18
4,540,397 9/1985 Lolachi et al. ..... 494/84
4,950,401 8/1990 Unger et al. ..... 210/360.1

FOREIGN PATENT DOCUMENTS

3242541C2 9/1987 Fed. Rep. of Germany .
56-76260A 6/1981 Japan .

*Primary Examiner*—Robert A. Dawson
*Assistant Examiner*—David Reifsnyder
*Attorney, Agent, or Firm*—Whitham, Curtis, Whitham & McGinn

[57] ABSTRACT

The invention relates to a centrifuge comprising a separation chamber, with which a duct is permanently connected, a main rotor, on which the separation chamber is able to be bearinged in a relatively rotatable manner with respect to it, by means of a bearing arrangement, and a guide means on the main rotor for guiding the duct from the middle lower part of the separation chamber into a part at a higher level than the centrifuge. In order to be able to introduce the separation chamber into the main rotor in a simple and controlled manner the bearing arrangement has, within the main rotor, a part which is open or is able to be opened in a radial direction for the introduction of the duct into the main rotor.

12 Claims, 3 Drawing Sheets

CENTRIFUGE

BACKGROUND OF THE INVENTION

The invention relates to a centrifuge comprising a separation chamber, with which a duct is permanently connected, a main rotor, on which the separation chamber is able to be bearinged, in a relatively rotatable manner with respect to it, by means of a bearing arrangement, and a guide means on the main rotor for guiding the duct from the middle lower part of the separation chamber into a part at a higher level than the centrifuge.

The most relevant prior art is constituted by the German patent 3,242,541, in which a centrifuge is described whose separation chamber is permanently connected with a duct. Such a centrifuge is designed without any sliding seals and renders possible a permanent connection between the separation chamber and the duct, which normally comprises a plurality of mutually parallel hoses or ducts in order to supply and drain off the components to be separated. As is described in this patent publication it is necessary to run the separation chamber at a speed of rotation twice that of the main rotor in order to prevent damage to the duct. A similar design is furthermore described in the U.S. Pat. No. 4,163,519.

In the case of the centrifuges described it turns out to be a disadvantage that the separation chamber is bearinged on the main rotor by means of a hollow pipe. It is necessary for the duct to be inserted through the hollow pipe so that insertion or removal of the separation chamber is awkward. For the insertion of a rigid separation chamber it is in fact necessary to thread the duct or, respectively, centrifuge hose through the bearing. Since a complex hose array is attached to the lower end of the centrifuge hose, it is necessary for the latter to be threaded through the hollow shaft of the bearing.

In accordance with a further prior art design the separation chamber is inserted and attached in the centrifuge from below. This is as well an awkward operation which has to be done blind. Furthermore the overall size of this arrangement is substantially larger than the size of the separation chamber, since the drive must be arranged around the separation chamber on the outside. This in turn makes necessary a generally bulky design of the centrifuge as a whole, which has disadvantages not only as regards the costs of manufacture but also as regards handling.

SHORT SUMMARY OF THE INVENTION

One object of the invention is to design a centrifuge of the sort noted initially which while having a simple structure and a simple construction renders possible a straightforward and rapid insertion of the separation chamber into the main rotor from above.

A still further object of the invention is to provide such a centrifuge which is operationally reliable in design.

Another object of the invention is the provision of a centrifuge which is characterized by a small overall size.

In accordance with the invention these aims are to be achieved since for the insertion of the duct in the main rotor the bearing arrangement has, at a position adjacent to the main rotor, a part which is at least able to be opened, that is to say, opens or is to be opened in a radial direction.

The centrifuge in accordance with the invention is characterized by a series of substantial advantages. Owing to the design of the bearing so that it is open or is able to be opened it is possible to push in the hose duct laterally without disassembly of the bearing being necessary and without it being necessary to thread the duct through the bearing. Therefore it is possible for the centrifuge hose or, respectively, the duct to be inserted from above, following which the separation chamber itself may be inserted or, respectively, mounted. Handling is consequently considerably facilitated and incorrect operation is prevented since the entire system is able to be inspected from above. Furthermore it is possible for the overall size to be minimized, because the main rotor itself is arranged underneath the separation chamber and its diameter does not have to be greater than that of the separation chamber. Consequently it is possible as well for the centrifuge to be designed as a bench top device with the result that there are many further possibilities of application.

In accordance with a further advantageous development of the invention the bearing arrangement has a spindle arranged on the separation chamber and a plurality of support wheels which are circumferentially distributed and are rotatably bearinged on the main rotor, and which are able to be brought into engagement with the spindle for supporting the same. The plurality of support wheels therefore constitute, because they are spaced apart, an "open bearing" which renders it possible to insert the duct.

In accordance with an alternative feature of the invention is such that the bearing would be split in a median, vertical plane and the two bearing shells would be designed so that they may be folded back or slid back. In this case as well a radial opening is present, through which the duct can be inserted or removed.

In keeping with yet another possible form of the invention there are respectively three support wheels arranged in two axially spaced planes in order to ensure a tilt-free bearing system for the axis of the separation chamber.

It is clear that it would be within the scope of the invention to provide four or more support wheels instead of three.

It is preferred for there to be at least one runner ring on the spindle of the separation chamber which is suitable for cooperation with the support wheels. The runner ring may for example be manufactured of harder material, and it is furthermore possible for it and/or the support wheels to be flanged. This means that there is an axial locking effect in order to hold the separation chamber in position, since the runner ring and support wheels can be positively in engagement with one another in order to provide an axial interlocking effect. However other means for axially locating the parts are possible, for example by a radially movable, spring-loaded ball or by similar components.

Furthermore it may be favorable for a gearing means to be provided on the spindle of the separation chamber in order to cause rotation of the separation chamber in a manner dependent on the rotation of the main rotor. As already described in the above, the separation chamber must be drivers at twice the angular velocity of the main rotor in order to ensure a corresponding twisting and untwisting of the duct. In this respect it is an improvement if the spindle itself bears the gearing means in order to ensure a positive rotary coupling between the separation chamber and the main rotor. The gearing means may for example be in the form of toothed gearing, such teeth then being in mesh with a pinion which is connected with a shaft, which for its part is rotatably mounted on the main rotor. The other end of the spindle is for example in engagement with a toothed ring, which is arranged on the a frame of the centrifuge. On rotation of the main rotor the spindle is consequently caused to rotate via the toothed ring and it drives the separation chamber via the pinion.

The support wheels may in accordance with the invention be designed to have an elastic effect in order to allow for imbalance so that there is a self-centering arrangement.

The separation chamber is preferably designed in the form of a throw-away article, which is for instance manufactured of a synthetic resin able to be recycled. Such separation chamber suitable for recycling in this case comprises one part of the drive or, respectively, of the bearing of the centrifuge owing to the gearing means and the runner rings.

The invention will now be described in the following with reference to working embodiments in connection with the drawings.

LIST OF THE SEVERAL VIEWS OF THE FIGURES

DETAILED ACCOUNT OF WORKING EMBODIMENTS OF THE INVENTION.

Figure 1:
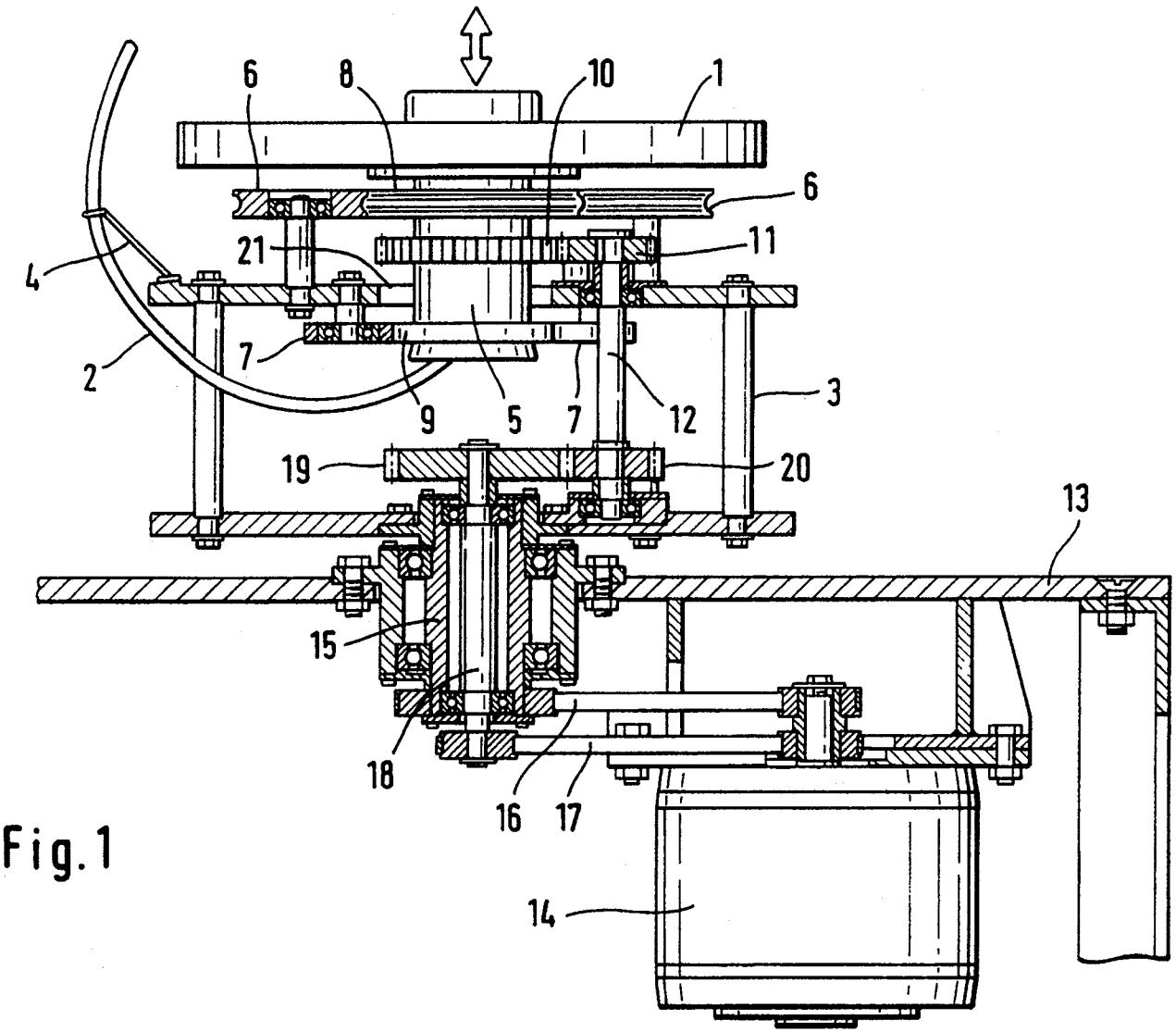
FIG. 1 is a lateral sectional elevation of a first working embodiment of a centrifuge in accordance with the invention.

The arrangement and structure illustrated in FIG. 1 of the centrifuge is with respect to many details the same as in the centrifuge in accordance with the said U.S. Pat. No. 4,163,519 so that in order to avoid repetition reference is to be had to such patent specification.

FIG. 1 shows a frame 13, on which a motor 14 is borne. At a higher level than the frame 13 there is a main rotor 3 designed in the form of a sort of subframe which is provided with a hollow shaft 15 which via a belt drive 16 is drivingly connected with the motor 14. A further belt drive 17 functions to drive a shaft 18 which is rotatably bearinged in the hollow shaft 13. At its top end the shaft 18 bears a gear wheel 19, which is in mesh with a pinion 20 which for its part is flanged on a shaft 12 whose upper era bears a pinion 11.

In the upper part of the main rotor 3 a recess 21 is formed, through which a spindle 5 of a separation chamber 1 may be inserted. The spindle 5 may be elastically connected with the separation chamber 1. In the middle part a duct 2 opens at the lower end of the spindle 5 and such duct is curved upwards in an arc as shown in FIG. 1. The main rotor 3 comprises a guide device (a loop of wire) 4 on which the duct 2 is held.

As a bearing means for the spindle 5 on the main rotor the latter has three upper support wheels 6 and three lower support wheels 7 arranged in an upper and, respectively, a lower plane, such wheels being equally spaced apart and consequently serving to support the spindle 5. The spindle 5 is provided with an upper runner ring 8 and a lower runner ring 9 on which the support wheels 6 and, respectively, 7 run. As shown in FIG. 1 the support wheels 6 and 7 are rotatably mounted on carrier rods or the like, since at the periphery three respective support wheels are provided with a spacing apart which permits the passage of the duct 2 for removal and placing in position of the separation chamber 1 (see the double arrow in the upper part of FIG. 1.).

There is furthermore a gearing means 10 on the spindle 5 in the form of toothed gear ring, which is in mesh with the pinion 11. The transmission ratios are so selected that the separation chamber 1 is driven at twice the speed of the main rotor 3. As regards the bearing means and the design of the duct 2 reference should be had to the said U.S. Pat. No. 4,163,519.

In the case of the working embodiment depicted in FIG. 1 it will be seen that the separation chamber 1 together with the spindle 5 secured thereto may be inserted and removed from above in a simple manner without the bearing arrangement, which is constituted by the upper and the lower support wheels 6 and 7, and the runner rings 8 and, respectively, 9 hindering the insertion and the removal thereof. It is unnecessary to thread the duct, as in the prior art, through a hollow shaft or for the separation chamber to be inserted from below. Since the spindle 5 of the separation chamber 1 is furthermore provided with the gear ring 10, an exact correspondence between the angular velocities of the separation chamber 1 and of the main rotor 3 is ensured.

Figure 2:
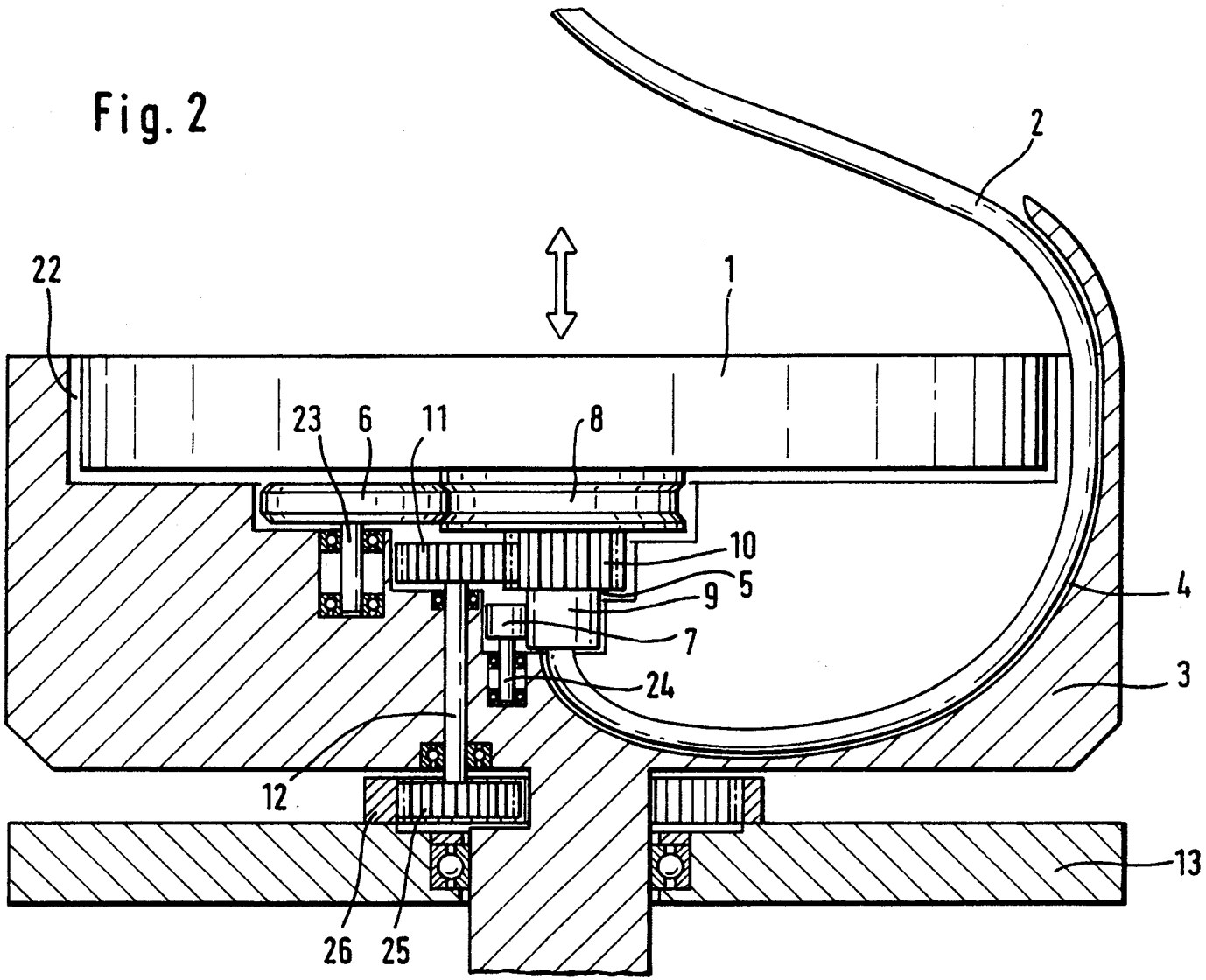
FIG. 2 is lateral elevation of part of a further working embodiment.
Figure 3:
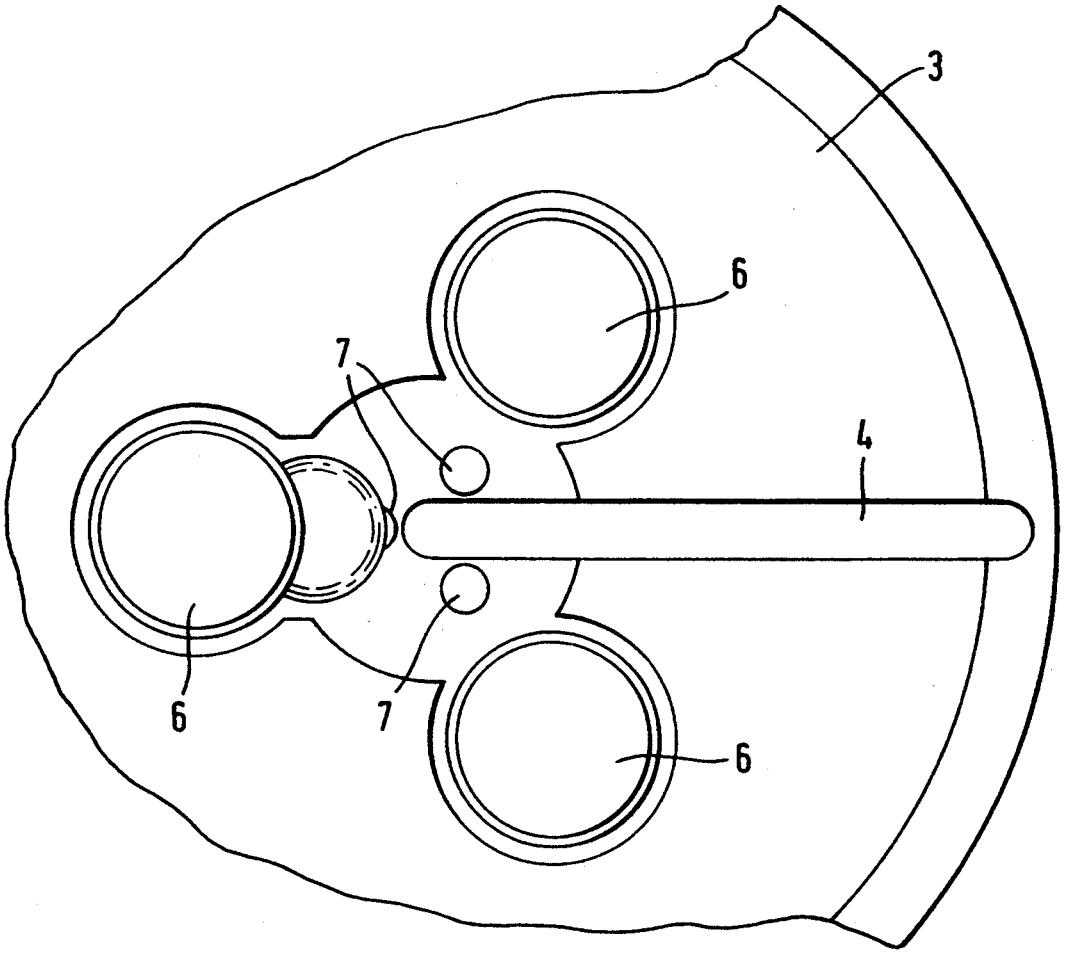
FIG. 3 is a plan view of part of the main rotor depicted in FIG. 2.

FIGS. 2 and 3 depict a further working embodiment of the centrifuge in accordance with the invention. Unlike the working embodiment illustrated in FIG. 1 in the case of the working embodiment of FIG. 2 the main rotor 3 is provided with a recess 22, into which the separation chamber i, as indicated by the double arrow, can be inserted. FIG. 2 furthermore indicates details of the arrangement and bearing system of the upper support wheels 6 and of the lower support wheels 7. The upper support wheel 6 has a shaft 23 which is accommodated in a recess in the main rotor 3 and is bearinged by means of two bearings. A shaft 24 of the lower support wheel 7 is received and bearinged in the same manner. In a similar manner the shaft 12 is bearinged, which at its end bears the pinion 11. FIG. 3 shows in plan that the three upper and the three lower support wheels 6 and 7 each have a distance apart, which renders possible lateral insertion of the hose or, respectively, of the duct 2. The guide device for the duct 2 is in the form of a groove 4, as shown in FIG. 3. The width of the groove 4 is somewhat greater than the diameter of the duct 2 with the result that the same is guided but is held too so that it cannot be turned as is necessary with the centrifuge described herein.

FIG. 2 further more indicates that the shaft 12, which is connected with the toothed gearing in the part 10 via the pinion 11, bears a gear wheel 25 at its end, which meshes with a toothed ring 26, which is permanently bearinged on the frame 13. By turning 3 the main rotor 3 using the motor 14, which is not illustrated in detail in FIG. 2, there is therefore a positive drive of the separation chamber 1 with the necessary angular velocity.

Although the above account has been limited to a few preferred embodiments of the invention, this has not been with the intention of limiting the invention thereto. In fact a man in the art will have available a large number of possibilities in order to implement the common inventive principle, more particularly as regards the design of the drive for the separation chamber.

We claim:

1. A centrifuge comprising:

a separation chamber, with which a duct is permanently connected, a main rotor, on which the separation chamber is able to be bearinged, in a relatively rotatable manner with respect to the separation chamber, by means of a bearing arrangement, a guide means on the main rotor for guiding the duct from a middle lower part of the separation chamber into a part at a higher level than the centrifuge, bearing means having, within the main rotor, a part which is at least able to be opened in a radial direction for the introduction of the duct into the main rotor, said bearing means further having a spindle connected to the separation chamber, and furthermore a plurality of circumferentially distributed support wheels which are rotatably bearinged on the main rotor.

2. The centrifuge as claimed in claim 1, further comprising three support wheels are provided in each of two axially spaced planes.

3. The centrifuge as claimed in claim 2, further comprising at least one runner ring on the spindle, said runner ring cooperating with the support wheels to provide bearinged circumferential support of the separation chamber.

4. The centrifuge as claimed in claim 3, wherein the runner ring and/or at least one support wheel is flanged for providing an axial positioning of the separation chamber.

5. The centrifuge as claimed in claim 3, wherein the runner ring and/or at least one support wheel is provided with axial locking means for holding the separation chamber in a defined axial position.

6. The centrifuge as claimed in claim 2, wherein the support wheels are elastic in order to allow for imbalance.

7. The centrifuge as claimed in claim 1, wherein the spindle has thereon a gearing means for rotational driving of the separation chamber in a manner dependent on the rotation of the main rotor.

8. The centrifuge as claimed in claim 7, wherein the gearing means, which is constituted by toothed gearing, is drivingly connected with a main rotor drive means via a shaft, which is rotatably bearinged on the main rotor and is provided with a pinion.

9. The centrifuge as claimed in claim 1, wherein the spindle is elastically connected with the separation chamber.

10. The centrifuge as claimed in claim 1, wherein the separation chamber is a throw-away article of synthetic resin able to be recycled.

11. A centrifuge comprising:

a separation chamber, with which a duct is permanently connected, a main rotor, on which the separation chamber is able to be supported, in a relatively rotatable manner with respect to the separation chamber, by bearing means, and a guide means on the main rotor for guiding the duct from a middle lower part of the separation chamber into a part at a higher level than the centrifuge, said bearing means having, within the main rotor, a part which is open in a radial direction for the introduction of the duct into the main rotor, said bearing means further having a spindle connected to said separation chamber and a plurality of support wheels engaging said spindle to provide both rotational support and axial positioning for said separation chamber.

12. A centrifuge comprising;

a separation chamber, with which a duct is permanently connected, a main rotor, on which the separation chamber is able to be supported, in a relatively rotatable manner with respect to the separation chamber, by bearing means, and a guide means on the main rotor for guiding the duct from a middle lower part of the separation chamber into a part at a higher level than the centrifuge, said bearing means having, with the main rotor, a part which is able to be opened in a radial direction for the introduction of the duct into the main rotor, said bearing means further having a spindle connected to said separation chamber, said spindle being supported by a plurality of wheels rotatably mounted to said main rotor.

* * * * *